US005138300A

United States Patent [19]

Chance

[11] Patent Number: 5,138,300

[45] Date of Patent: Aug. 11, 1992

[54] WATER IMMERSION ALARM SYSTEM

[76] Inventor: James M. Chance, 501 E. Irene, Casa Grande, Ariz. 85222

[21] Appl. No.: 600,630

[22] Filed: Oct. 22, 1990

[51] Int. Cl.[5] ..... G08B 21/00

[52] U.S. Cl. ..... 340/573; 340/604; 340/693

[58] Field of Search ..... 340/573, 693, 604

[56] References Cited

U.S. PATENT DOCUMENTS 4,348,562 9/1982 Florin ..... 340/573
4,714,914 12/1987 Boe ..... 340/573
4,847,592 7/1989 Esch et al. ..... 340/573
4,918,433 4/1990 Moore ..... 340/573

*Primary Examiner*—Glen R. Swann, III
*Attorney, Agent, or Firm*—Tod R. Nissle

[57] ABSTRACT

A water immersion alarm system mounts a water sensor-transmitter carrier unit on the person of a child in a manner that prevents the child or a friend of the child from removing the carrier unit from the child and that prevents a stick, wire, or other elongate object from sliding between the carrier unit and the body of the child to impale the child.

7 Claims, 1 Drawing Sheet

WATER IMMERSION ALARM SYSTEM

BACKGROUND OF THE INVENTION

1. Field of the Invention

The invention relates to water immersion alarm systems which include a water sensor device and a transmitter which is activated when the sensor device is immersed in water.

More particularly, the invention relates to a water immersion alarm system which mounts a water sensor-transmitter carrier unit on the person of a child in a manner that prevents the child or a friend of the child's from removing the carrier unit from the child and that prevents a stick, wire, or other elongate object from sliding between the carrier unit and body of the child to impale the child.

In a further respect, the invention relates to a water immersion alarm system which facilities the concealment on the person of a water sensor device and transmitter.

2. Description of the Related Art

Water immersion alarm systems are well known in the art. See, for example, U.S. Pat. No. 4,918,433 to Moore. Such prior art immersion systems are mounted on an individual using a strap or band which encircles the waist, wrist or other part of the body. A water sensor and transmitter are mounted on the belt. When the sensor detects water, the transmitter is activated.

Belts or bands which encircle the body have several disadvantages. First, bands or belts ordinarily can be removed by children, even when the children are young. This ability of young children to remove belts or bands makes the use of belts undesirable. It is possible to provide a belt or band with a lock which makes it difficult to remove the strap. This is undesirable in the event it is necessary to quickly remove the belt. Second, belts permit wire, sticks, or other elongate objects to work their way between the strap and body of the person wearing the strap. This danger associated with belts is especially undesirable with respect to children, who are notorious for getting "hung up" and injured in every possible way. Third, bands and belts are readily visible to the friends of the user and are an invitation for the friends, particularly when the friends are children, to remove the belt from the user. Fourth, many individuals do not want to wear auxiliary wristbands, belts, or other devices because the devices are uncomfortable or are not aesthetically pleasing.

Accordingly, it would be highly desirable to provide an improved water immersion alarm system including a water sensor and transmitter unit which cannot be readily manually removed, which is shaped and dimensioned to avoid entanglement with and impalement by wire, sticks, or other elongate objects, which is not visible to the friends of the person wearing the unit, and which is comfortable to wear.

Therefore, it is a principal object of the invention to provide an improved water immersion alarm system A further object of the invention is to provide an improved water immersion system including a carrier unit which has a water sensor and has a transmitter which is activated when the sensor is immersed in water.

Another object of the invention is to provide an improved water immersion system of the type described in which the carrier unit is concealable on the person and is mounted such that it can not be manually removed by the person without the aid of tools.

Still a further object of the invention is to provide an improved water immersion system of the type described in which the carrier unit is mountable either on the epidermis of or on a garment worn by a person.

These and other, further and more specific objects and advantages of the invention will be apparent to those skilled in the art from the following detailed description thereof, taken in conjunction with the drawings, in which:

SUMMARY OF THE INVENTION

Briefly, in accordance with my invention, I provide an improved immersion alarm system. The system includes a carrier having a backing and shaped and dimensioned to be carried on the person without encircling a portion of the body of the person; attachment means removably securing the carrier on the person; means mounted on the carrier for sensing when the carrier is immersed in water and generating water immersion signals; transmitter means mounted on the carrier and responsive to the water immersion signals to generate receiver activation signals for airborne transmission; receiver means positioned at a location remote from the transmitter means and responsive to the airborne receiver activation signals to generate alarm activation signals; and, alarm means positioned at a location remote from the transmitter means and responsive to the alarm activation signals to generate alarm signals. The attachment means secures the carrier on the person without encircling a portion of the body of the person; holds the backing against, removably secures the carrier at a fixed location on, and contacts at least a portion of one of the pair comprising the epidermis of the person, and a garment on the person; and, prevents, after the carrier is secured on the person by the attachment means, the fingers on the hand of another person from being able to slide intermediate the attachment means and the portion of the one of the pair contacted by the attachment means and intermediate the carrier and the portion of the one of the pair contacted by the attachment means.

DESCRIPTION OF THE PREFERRED EMBODIMENTS

Figure 1:
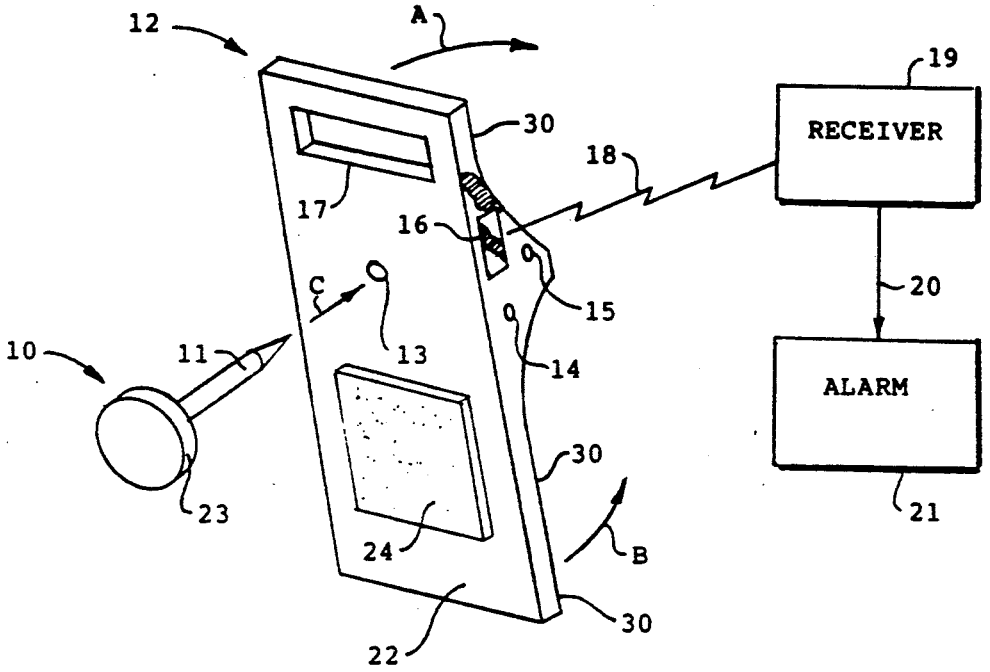
FIG. 1 is an assembly—schematic view of a water immersion alarm system constructed in accordance with the principles of the invention; and, FIG. 2 is a perspective view illustrating the engagement and impalement of a belt by a wire passing inside the belt.

Turning now to the drawings, which depict the presently preferred embodiments of the invention for the purpose of illustrating the practice thereof and not by way of limitation of the scope of the invention, and in which like reference characters refer to corresponding elements throughout the several views, FIG. 1 illustrates a water immersion alarm system constructed in accordance with the invention and including a carrier unit 12, attachment means 10, receiver 19, and alarm 21. Carrier unit 12 is presently preferably constructed of a substantially rigid plastic. The upper and lower ends of unit 12 can be bent inwardly in the directions indicated by arrows A and B with the use of a hand held tool which maintains the portion of unit 12 intermediate the upper and lower ends in fixed position while applying pulling forces on the ends in the directions indicated by arrows A and B. Attachment means or fastener 10 includes cylindrical head 23 and elongate pointed shaft or neck 11 attached to head 23. In order to secure unit 12 to a garment, unit 12 is positioned on one side of the garment and fastener 10 is positioned on the other side of the garment Pointed neck 11 is pushed through the garment and into aperture 13 of unit 12. A pair of flat opposed spring steel flanges (not visible) inside unit 12 and positioned along aperture 13 slidably frictionally engage neck 11. The flanges are canted away from backing 22 toward electrical contact 15. After fastener 10 is displaced in the direction of arrow C to insert neck 11 in aperture 13 and between the spring-flanges and compress the garment between head 23 and backing 22, fastener 10 cannot be pulled outwardly away from backing 22 because the canted flanges along aperture 13 dig into neck 11 and prevent neck 11 from moving. When, however, a tool is used to bend the upper and lower ends of unit 12 in the directions indicated by arrows A and B, the flanges are pulled apart and away from neck 11 so that neck 11 can be readily slid out of aperture 13 in a direction opposite the direction indicated by arrow C.

A transmitter 16 is mounted in unit 12, along with electrical contacts 14 and 15. A conductor (not shown) leads from contact 14 to transmitter 16. Another conductor (not shown) leads from contact 15 to transmitter 16. When unit 12 is immersed in water, the water electrically bridges contact 14 and 15, closing the circuit and producing water immersion electrical signals which activate transmitter 16. A battery (not shown) powers the transmitter-contact 14, 15 circuit. A variety of means for sensing the immersion of unit 12 in water and activating a transmitter 16 are well known in the art and will not be discussed here. When the unit 12 is immersed in water and transmitter 16 is activated, receiver activation signals 18 are produced by the transmitter. The signals typically travel through the water and through the air to receiver 19. Receiver 19 is located at a location remote from the reservoir of water in which unit 12 is immersed. Typically, where the reservoir of water comprises a residential swimming pool, the receiver 19 is located in the home adjacent the pool, along with the alarm 21. Receiver 19 is responsive to the airborne receiver activation signals to generate alarm activation signals 20 which are transmitted to alarm 21 through the air, through an electrical cable, through a photoelectric cable, or by any other desired signal transmission means. When alarm 21 receives the alarm activation signals 20, alarm 21 generates signals which can comprise audio, visual, olfactory, or other signals to notify individuals inside or outside of the home that the individual wearing unit 12 is in water.

Instead of fastener 10, adhesive pad 24 can be utilized as the attachment means for mounting unit 12 on the person. Adhesive pad 24 permits unit 12 to be removably attached to a garment or to the epidermis of the person Pad 24 can cover a portion of or all of backing 22. Aperture 17 is formed through unit 12 to facilitate the use of clips or other means to removably secure unit 12 to a garment. When adhesive pad 24 is utilized, it is sometimes preferable that unit 12 comprise a pliable integument or tape which can readily contour to the epidermis while carrying transmitter 16, contacts 14 and 15, and the conductor interconnecting contact 14 and transmitter 16. A unit 12 comprised of a pliable integument is particularly useful for a small child because unit 12 can be adhered to the back of a child or inside of the child's diapers or pants. The child is normally unable to reach his back or to reach beneath his diapers or pants to remove the pliable integumental unit 12. For older children, the placement of the pliable integument unit 12 on the epidermis of the child underneath the child's clothing conceals unit 12 from friends of the child and also makes it difficult for the child to remove the pliable unit 12. While the rigid plastic embodiment of unit 12 illustrated in FIG. 1 can also be mounted under clothing worn by a child, the inability to manually remove unit 12 without the use of a hand tool makes such concealment less necessary.

Figure 2:
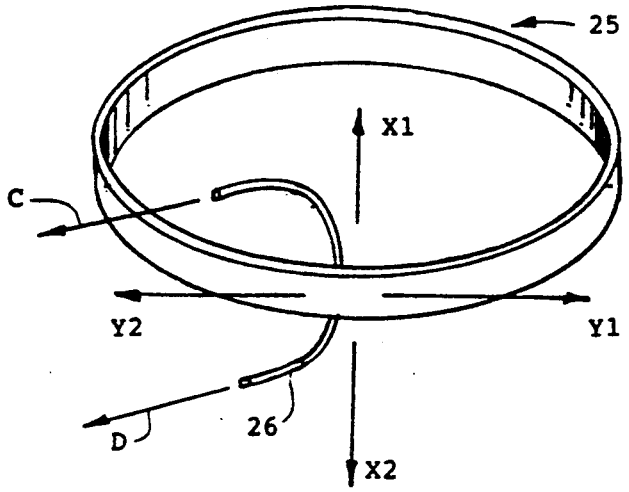

In FIG. 2, a conventional belt or strap 25 is generally indicated by reference character 25. Most belts, unless they are very tightly mounted about a portion of an individual's body, permit a wire or other elongate object to readily pass intermediate the belt 25 and the individual's body. When the distal ends of wire 26 are grasped and pulled in the directions indicated by arrows C and D, the wire 26 does not, or course, come free from the belt 25 but simply pulls outwardly against belt 25. Similarly, after the distal ends of wire 26 are grasped and pulled in the directions indicated by arrows C and D, further moving the wire 26 laterally in any of the directions indicated by arrows X1, X2, Y1 and Y2 does not permit the wire 26 to be pulled free from belt 25. When the distal ends of wire 26 are grasped, a closed loop is formed which is comprised of wire 26, making it impossible to pull wire 26 free from belt 25. A particular advantage of the embodiment of the invention which utilizes fastener 10 is that it is not a simple matter, if it is possible at all, for a thin elongate object to pass intermediate head 23 and backing 22. Similarly, a wire 26 cannot be slid between adhesive pad 24 and carrier 22 or between pad 24 and the epidermis or clothing to which pad 24 is attached. It is therefore unlikely that a person wearing unit 12 can become entangled and impaled on a wire, stick, etc. When fastener 10 or pad 24 is utilized as attachment means to secure unit 12 to a garment or to the epidermis, respectively, of a person, it also is not possible for an individual to slide the fingers of a hand intermediate the attachment means and the garment or epidermis or to slide the fingers intermediate unit 12 and the garment or epidermis. Manually grasping and pulling unit 12 off the person is not readily accomplished.

Unit 12 is preferably rather small to facilitate concealment of unit 12 on the person. While the size of unit 12 can vary as desired, unit 12 is presently typically about one inch wide and three inches long and is made of a lightweight plastic, fabric or other material. The outer face 30 of unit 12 can be shaped and dimensioned to contour to a portion of the body when unit 12 is mounted on the inside of a garment with face 30 adjacent a portion of the body. Contouring face 30 to the body facilitates the concealment of unit 12 on the person. Unit can be shaped and dimensioned to contour to a garment like a shoe or a hat and can be colored and textured to blend in with and escape detection when worn on the exterior or outer surfaces of clothing. Unit 12 can also be shaped to simulate a tie tack, pin, or other item worn on the clothing of a person.

When it is desired to fixedly attach carrier unit 12 to a garment on the person, fastener 10 or another fastener which prohibits the manual removal of unit 12 from a garment is preferred. U-shaped clips of the type found on measuring tape housings and other objects which clip on to a belt are not preferred. Such U-shaped clips are readily manually pulled free from a belt. Fastener 10 effectively maintains unit 12 at a fixed location on a garment because fastener 10 extends through the garment, contacts the garment, and compresses the garment against backing 22 of unit 12. Fastener 10 is also preferred for fixedly attaching a carrier unit 12 to a garment because a special hand tool is required to remove fastener 10 from unit 12. An individual cannot remove fastener 10 utilizing only his hands. The individual must use a hand tool to remove fastener 10.

Having described my invention in such terms as to enable those skilled in the art to understand and practise it, and having identified the presently preferred embodiments thereof, I claim:

1. An immersion alarm system including (a) a portable, pliable carrier mounted on a user and having an adhesive backing for securing said carrier to the skin of the user, said carrier readily contouring to the body of the user;

(b) sensor means mounted and contained in whole on said carrier for sensing when said carrier is immersed in water and generating water immersion signals;

(c) transmitter means mounted and contained in whole on said carrier and responsive to said water immersion signals to generate receiver activation signals for transmission;

(d) receiver means positioned at a location remote from said transmitter means and responsive to said receiver activation signals to generate alarm activation signals;

(e) alarm means positioned at a location remote from said transmitter means and responsive to said alarm activation signals to generate alarm signals; and, (f) self-contained power means mounted on said carrier for providing motive power to operate said sensing means and said transmitter means.

2. The system of claim 1 wherein said carrier is shaped and dimensioned to be concealed underneath a diaper.

3. An immersion alarm system including (a) a portable carrier shaped and dimensioned to be concealed on a user intermediate the epidermis of the person and a garment worn on the person and including attachment means for removably attaching said carrier at a fixed location to at least one of the pair comprising said epidermis and said garment, said carrier including a substantially rigid face shaped and dimensioned to contour to a selected portion of the body of the user;

(b) sensor means mounted on said carrier for sensing when said carrier is immersed in water and generating water immersion signals;

(c) transmitter means mounted on said carrier and responsive to said water immersion signals to generate receiver activation signals for transmission;

(d) receiver means positioned at a location remote from said transmitter means and responsive to said receiver activation signals to generate alarm activation signals;

(e) alarm means positioned at a location remote from said transmitter means and responsive to said alarm activation signals to generate alarm signals; and, (f) self-contained power means mounted on said carrier for providing motive power to operate said sensor means and said transmitter means.

4. The immersion system of claim 3 wherein said carrier is colored and textured to blend in with said garment.

5. A method for monitoring when a small child enters a reservoir of water, including the steps of dressing the child with a diaper; and, concealing a portable self-contained immersion sensor unit at the back of the child and intermediate the diaper and the body of the child, said immersion sensor unit including (i) a carrier sized to fit on the back of the child and including means for removably attaching said carrier to at least one of the pair comprising the epidermis of the child and the diaper, (ii) sensor means mounted on said carrier for sensing when said carrier is immersed in water and generating water immersion signals, (iii) transmitter means mounted on said carrier and responsive to said water immersion signals to generate receiver activation signals for airborne transmission;

(c) positioning receiver means at a location remote from said reservoir, said receiver means being responsive to said airborne receiver activation signals to generate alarm activation signals; and, (d) positioning alarm means at a location remote from said reservoir, said alarm means being responsive to said alarm activation signals to generate alarm signals.

6. The method of claim 5 wherein said sensor means includes electrical contact points which, when bridged with water, close a circuit and generate said water immersion signals, said contact points being spaced away from said diaper and from the body of said child.

7. The method of claim 5 wherein (a) said carrier is pliable and contours to the body of the child; and, (b) said attaching means comprises adhesive for attaching said carrier to the epidermis of said child.

* * * * *